US008556133B2

(12) United States Patent
Copplestone-Bruce

(10) Patent No.: US 8,556,133 B2
(45) Date of Patent: Oct. 15, 2013

(54) VALVE AND DISPENSER

(76) Inventor: John Merlin Copplestone-Bruce, Preston (GB)

( * ) Notice: Subject to any disclaimer, the term of this patent is extended or adjusted under 35 U.S.C. 154(b) by 542 days.

(21) Appl. No.: 12/601,786

(22) PCT Filed: May 29, 2008

(86) PCT No.: PCT/GB2008/001830
§ 371 (c)(1),
(2), (4) Date: Nov. 24, 2009

(87) PCT Pub. No.: WO2008/146001
PCT Pub. Date: Dec. 4, 2008

(65) Prior Publication Data

US 2010/0170922 A1 Jul. 8, 2010

(30) Foreign Application Priority Data

May 29, 2007 (GB) ..... PCT/GB2007/001991

(51) Int. Cl.
*B65D 83/00* (2006.01)

(52) U.S. Cl.
USPC ..... 222/399; 222/396; 222/397; 251/325; 137/528

(58) Field of Classification Search
USPC ..... 222/396, 397, 399; 251/210, 325; 137/528
See application file for complete search history.

(56) References Cited

U.S. PATENT DOCUMENTS

| | | | | |
|---|---|---|---|---|
| 2,189,643 | A * | 2/1940 | Ward | 141/17 |
| 2,906,492 | A * | 9/1959 | Conrad | 251/325 |
| 3,556,128 | A * | 1/1971 | Scaglione | 137/219 |
| 3,827,449 | A * | 8/1974 | Gurizzan et al. | 137/68.22 |
| 4,473,174 | A | 9/1984 | Heuser | |
| 4,595,121 | A | 6/1986 | Schultz | |
| 4,880,366 | A * | 11/1989 | Stinson | 417/555.1 |
| 4,982,879 | A | 1/1991 | Corrado et al. | |
| 6,412,668 | B1 * | 7/2002 | Vlooswijk et al. | 222/396 |
| 6,499,632 | B2 * | 12/2002 | van't Hoff | 222/389 |
| 8,006,873 | B2 * | 8/2011 | Vanblaere et al. | 222/389 |
| 2006/0192168 | A1 | 8/2006 | Thompson | |

FOREIGN PATENT DOCUMENTS

| | | |
|---|---|---|
| CN | 93219221.1 | 5/1994 |
| CN | 97242238.2 | 7/1999 |
| DE | 516046 C | 1/1931 |
| DE | 524397 C | 5/1931 |
| DE | 615553 C | 7/1935 |
| DE | 681090 | 9/1939 |

(Continued)

OTHER PUBLICATIONS

Qu Jinfang; State Intellectual Property Office of the People's Republic of China; First Office Action; Oct. 11, 2010; 7 pages; Haidian District, Beijing, China.

*Primary Examiner* — Kevin P Shaver
*Assistant Examiner* — Nicholas J Weiss
(74) *Attorney, Agent, or Firm* — Maier & Maier, PLLC

(57) ABSTRACT

A valve comprising an inlet and an outlet, the valve having a valve element moveable between a first equilibrium position and a second open position, wherein when the valve element is in the first position, the inlet and the outlet are not in flow communication and when the valve element is in the second position the inlet and the outlet are in flow communication, and wherein the valve element is moveable between the first position and the second position in response to the pressure at the inlet and the outlet.

16 Claims, 4 Drawing Sheets

(56) References Cited

FOREIGN PATENT DOCUMENTS

Figure 1A:
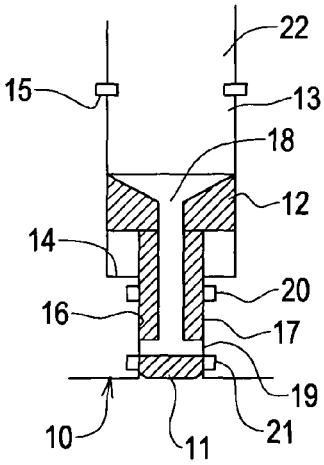

| | | | | |
|---|---|---|---|---|
| DE | 681090 | C | | 9/1939 |
| DE | 29823474 | U1 | | 7/1999 |
| DE | 29823474 | U1 | | 9/1999 |
| GB | 1439559 | | | 6/1976 |
| JP | 04327072 | A | * | 11/1992 |
| WO | WO 02/066363 | | | 8/2002 |

* cited by examiner

VALVE AND DISPENSER

DESCRIPTION OF INVENTION

This invention relates to a valve and a dispenser comprising a valve.

Where a pressure within a volume is required to be controlled, and supplied with pressure from a source, it is known to provide an appropriate valve. Known valves however are complex, with biasing elements and control mechanisms, and not generally suitable for many applications.

According to a first aspect of the invention, we provide a valve comprising an inlet and an outlet, the valve having a valve element moveable between a first equilibrium position and a second open position, wherein when the valve element is in the first position, the inlet and the outlet are not in flow communication and when the valve element is in the second position the inlet and the outlet are in flow communication, and wherein the valve element is moveable between the first position and the second position in response to the pressure at the inlet and the outlet.

The valve element may comprise a piston having a first surface area responsive to pressure at the outlet and a second smaller surface area responsive to the pressure at the inlet, wherein the piston may be moveable in response to the net force on the first and second surface areas.

The piston may be moveable in a first bore in flow communication with the outlet and the second surface area may be provided on a rod attached to the piston and moveable in a second bore in flow communication with the inlet.

A through-bore may be provided in the rod, and an upper seal and a lower seal may be provided to provide a sliding seal between the rod and the second bore.

In the second position, an end part of the rod may be located between the upper seal and lower seal such that fluid is able to pass the lower seal, around the rod and enter the throughbore.

The valve element may be moveable to a third position in response to the pressure at the inlet and outlet wherein the inlet and outlet are not in flow communication.

The valve element may be moveable to a fourth position to permit fluid flow from the outlet to the inlet.

The valve element may move between the first position and the second position solely in response to the pressures at the inlet and outlet and no bias element or control element may be present to move the valve element between the first and second positions.

An example use of the valve is in a dispenser for liquid, such as an aerosol. Conventionally, such dispensers are filled with a propellant comprising a volatile organic compound such as propane, butane or ISO-butane. Such propellants have such low boiling points that that when introduced to an aerosol or cigarette lighter they comfortably remain as liquids at low pressures which boil off at low temperatures as pressure decreases when the aerosol is used. It is known that these propellants are inflammable and toxic. Inert or less harmful propellants such as nitrogen or carbon dioxide have been considered. However, for nitrogen to be a liquid requires it be held captive at some 4000 psi and carbon dioxide at 815 psi, which is too high to be contained within conventional aerosol containers. Consequently, the expansion to pressure curve of these gases are such that when deployed in conventional aerosol canisters, where the internal pressure is conventially in the range 60-120 psi, the pressure in the container depletes too rapidly as the contents are used and the rate of discharge is reduced.

According to a second aspect of the invention, we provide a dispenser comprising a container and an nozzle to release liquid under pressure from the container, the dispenser further comprising a pressure source to supply fluid under pressure to the container, the pressure source and container being connected by a valve according to the first aspect of the invention.

The pressure source may be releasably connectable to the container.

The pressure source may comprise the valve and a pressure bottle.

The container may have a connection part to engage the pressure source, the connection part having a push rod to urge the valve element from the third position to the second position when a pressure source is engaged with the container.

The nozzle is connectable to a tube extending into the container, to permit liquid to be dispensed from the container.

The liquid may be dispensed as one of a spray, a jet or a foam.

Figure 1B:
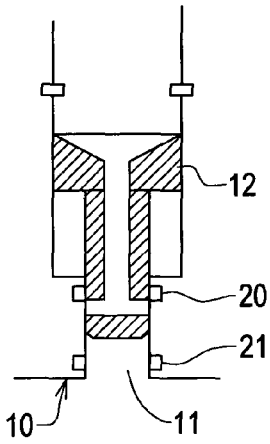
Figure 1C:
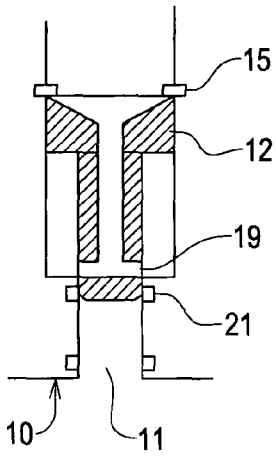
Figure 1D:
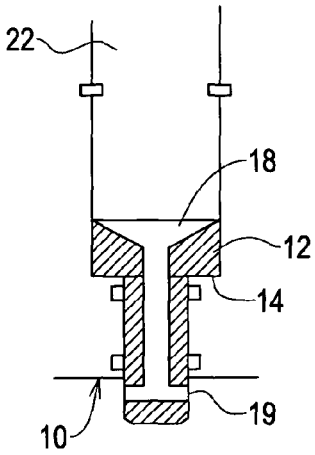
Figure 2:
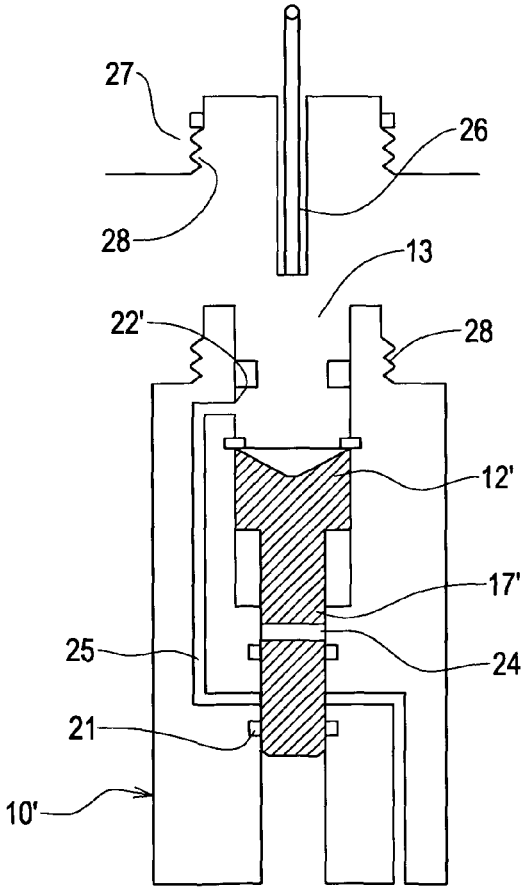
Figure 3:
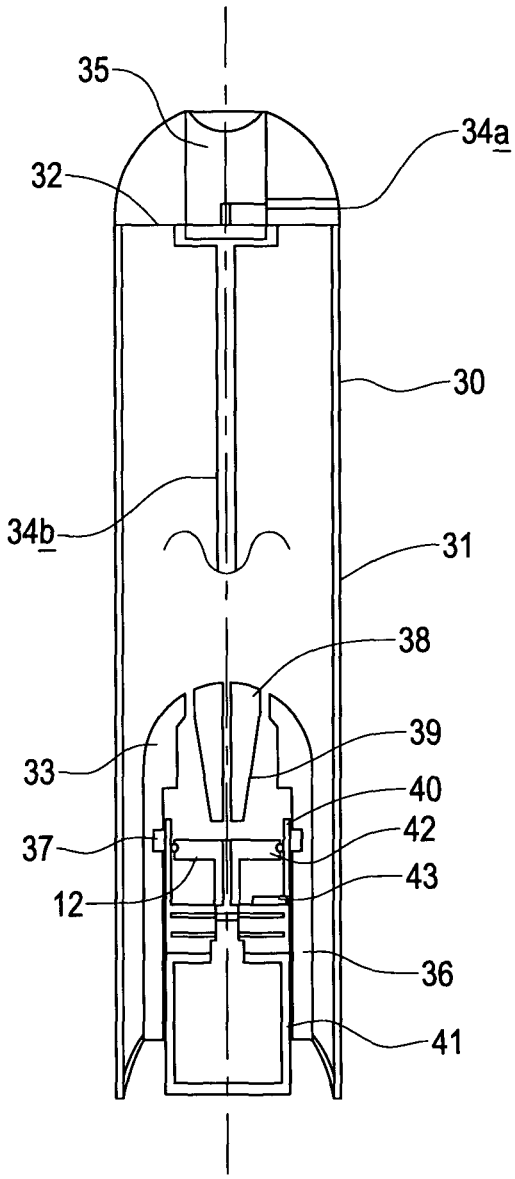
Figure 4:
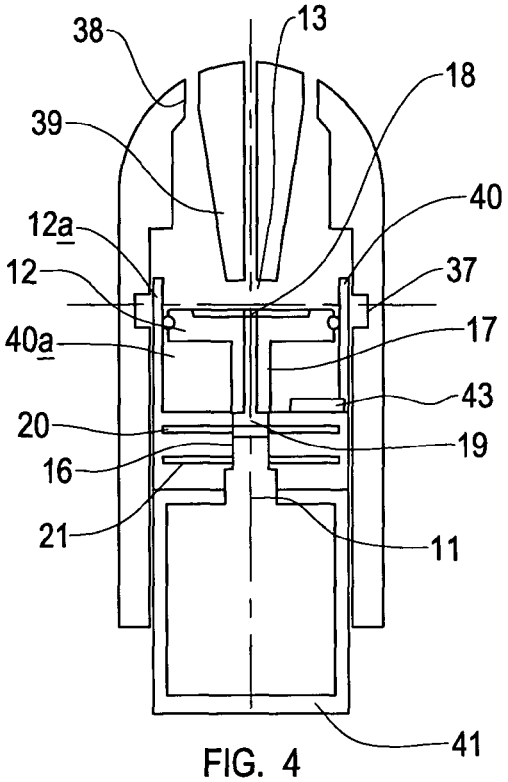
Figure 5:
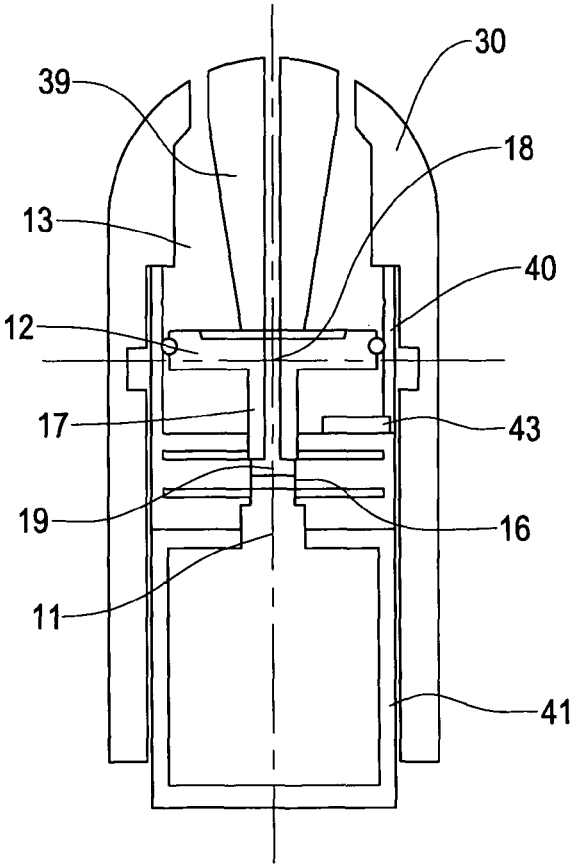
Figure 6:
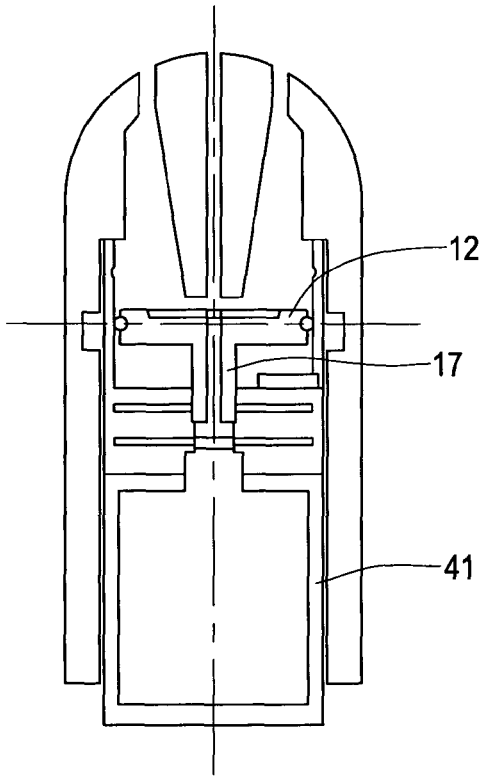
Figure 7:
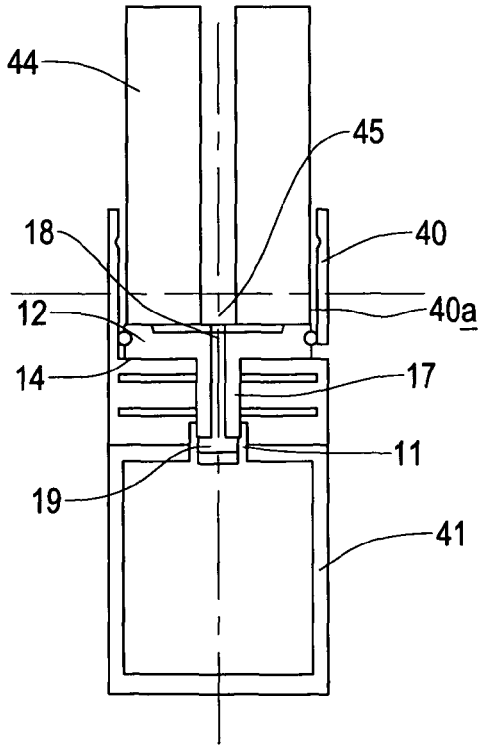

Embodiments of the invention will now be described by way of example only, with reference to the accompanying drawings, wherein;

FIG. 1*a* is a sectional view of a valve embodying the present invention,

FIG. 1*b* is a sectional view of the valve of FIG. 1*a* in a second position FIG. 1*c* is a sectional view of the valve of FIG. 1*a* in a third position FIG. 1*d* is a sectional view of the valve of FIG. 1*a* in a fourth position, FIG. 2 is a sectional view of an alternative valve, FIG. 3 is a sectional view of a dispenser comprising the valve of FIG. 1, FIG. 4 is a view on a larger scale of part of the dispenser of FIG. 3, in a first operating position, FIG. 5 is a view on a larger scale of part of the dispenser of FIG. 3, in a second operating position, FIG. 6 is a view on a larger scale of part of the aerosol of FIG. 3, in a second operating position, and, FIG. 7 is a sectional view of a pressure canister of the dispenser of FIG. 3.

A valve embodying the present invention is generally shown at 10 in FIGS. 1*a* to 1*d*. The valve 10 is suitable for use in any suitable application where a controlled supply of fluid pressure is required. The valve 10 comprises an inlet 11 to which fluid under pressure is supplied. The pressurized fluid may be gas supplied from, for example, a gas canister. A piston 12 is moveable within a first bore 13, its movement being constrained in this example by an end 14 of the first bore 13 and a circlip 15. A second bore 16 having a smaller diameter than the first bore 13 extends from the first bore 13 to the inlet 11. A piston rod 17 is connected to the piston 12 and is slidably moveable within the second bore 16. A channel 18 extends from the upper face of the piston 12 through the piston rod 17 and has one or more ports 19. An upper o-ring seal 20 and a lower o-ring seal 21 supported in grooves in the second bore 16 provide a sliding seal between the piston rod 17 and the second bore 16. An upper part of the first bore 13 provides an outlet. The volume of the bore 13 between the piston 12 and the end 14 of the bore 13 is preferably at a lower pressure, for example venting to atmosphere via a suitable port (not shown). As such, the piston 12 is able to move freely in response to the net force from the different pressures at the inlet 11 and the outlet acting on the larger surface area of the piston 12 and the smaller surface area of the end of the piston rod 17.

FIG. 1*a* shows the valve 10 in a first, equilibrium, position, where the lower pressure at the outlet and hence in the bore 13 is balanced by the higher pressure in the inlet and applied to the smaller area of the end of the rod 17. Accordingly, there is no net force on the piston 12, or insufficient net force on the piston 12 to cause the piston to move against any frictional forces such as between the seals 20, 21 and the piston rod 17.

When the pressure at the outlet falls, as shown in FIG. 1*b* the piston 12 is forced upwards to a second, open position, as the force applied to the piston 12 will be less than the upwards force due to the higher pressure at the inlet 11 acting on the smaller area of the end of the rod 17. The piston 12 will be urged upwards, moving the lower part of the piston rod 17 out of contact with the lower O-ring 21. As the tolerance between the rod 17 and the second bore 16 will not be exact, fluid under pressure will flow through the inlet 11, the ports 19 and channel 18 into the outlet 22. When the pressure at the outlet has increased sufficiently, the downwards force on the piston 12 will exceed the upward force on the end of the rod 17, and the piston 12 will return to the first position of FIG. 1*a*.

In a third position as shown in FIG. 1*c*, the pressure in the first bore 13 has been completely released, or reduced to atmospheric or ambient pressure, for example due to the valve 10 being deliberately removed from a dispenser, or due to a leak or otherwise. In this case, the pressure at inlet 11 will force the piston 12 upwards until it engages circlip 15 and the ports 19 are above the upper O-ring seal 20. No fluid under pressure can then pass from the inlet 11 to the outlet 22, and so the valve 10 is in a safe condition.

Where a gas container comprises the source of fluid under pressure, the valve 10 can also be used to refill a gas container. As shown in FIG. 1*d*, a refill pressure applied to the outlet 22 forces the piston 12 downwards until it reaches a fourth position, in this example when the piston engages the end 14 of the bore 13. The channel 18 and ports 19 provide a fluid connection allowing fluid under pressure to pass from the outlet 22 to the inlet 11. When the pressure is released from the outlet 22, the piston 12 will be urged upwards until it reaches the position shown in FIG. 1*c*. Alternatively, rather than simply use the refill pressure to urge the piston 12 to a fourth position, a suitable physical mechanism such as a push rod can be used to move the piston 12 to the fourth position when the valve is engaged with a source of refill pressure, and permit the piston 12 to return to the third position shown in FIG. 1*c* when the valve 10 is disconnected from the source of refill pressure. The fourth position may be defined by some other stop, such as a circlip within the bore, if it is desirable for the piston 12 not necessarily to contact the end face 14.

It will be apparent that any other suitable configuration of channels may be provided in the valve to allow for a connection between the inlet 11 and outlet. FIG. 2, shows an alternative piston 12' and rod 17' in which the rod 17' is solid apart from a through-bore 24, and the rod 17' is sufficiently long that it is always in sealing contact with the lower O-ring 21. Movement of the piston 12' causes the through-bore 24 to open and close a supply channel 25 to supply fluid to an outlet 22' in flow communication with the bore 13.

When the valve 10, 10' is connection to a device such as a dispenser which is to be supplied with pressurised fluid, it will be apparent that the piston 12 will be in the third position as shown in FIG. 1*c*. To cause the valve 10 to permit fluid under pressure to pass from the inlet 11 to the outlet of the bore 13, it is necessary for some physical element to initially move the piston 12 to the second position. In the example of FIG. 2, a push rod 26 is provided as part of a connector 27 on a device to which the valve 10 is attached via a threaded connection 28. As the valve 10 is screwed onto the threaded connection 28, the push rod 23 will come into contact with the piston 12, and displace the piston 12 from the closed position of FIG. 1*c* allowing pressure to pass from the inlet 11 to the bore 13. Once the pressure within the device and hence at the bore 13 rises sufficiently, the piston 12 will move to the first, equilibrium position and subsequently operate as discussed above in response to changes in the pressure at the bore 13.

If the valve 10 is not intended to be able to permit refilling of a pressure source, then the valve may be configured such that the piston 12 is not able to move to the fourth position as shown in FIG. 1*d*. This may be achieved, for example, by selecting the length of the rod 17 such that it cannot extend beyond the lower O-ring 21, or by limiting the range of travel of the piston 12 by the position of the end 14 of the bore 13, or providing a further circlip, or otherwise.

It will be apparent that the valve 10 may be used in any suitable application, where it is desired to supply fluid under pressure from a source at a higher pressure to a device or volume at a lower pressure. The source may be a container holding fluid under pressure, such as a gas bottle, or a pressure line, or a pump, or any other suitable source. The construction of the valve is simple, without the need for biasing or control devices, and the relative dimensions of the piston 12 and rod 17 can be selected in accordance with the desired pressure of the source and the outlet pressure. The valve 10 is suitable for miniaturisation and simple to manufacture.

An example application of the valve will now be described with reference to FIGS. 3 to 7. A dispenser is shown at 30, in this example comprising an aerosol operable such that the contents of the dispenser are ejected as a mist, spray or foam, but may be any other type of dispenser as desired. The dispenser 30 comprises a container 31 for holding a liquid to be dispensed, closed by a cap 32 at the upper end of the container 31. A connection part 33 is disposed at the lower part of the container 31 to receive a source of gas pressure, as discussed in more detail below. The cap 32 has a nozzle 34*a* and a dip tube 34*b* extending into the body of the container 31. A button 35 is provided which, when pressed, connects the dip tube 34*b* to the nozzle 34*a* so that liquid is forced from the container 31 by the pressure in the container 31, through the dip tube 34*a* and out through the nozzle 34*a*.

The connection part 33 comprises a generally cylindrical body 36 with an internal seal 37. Vents 38 connect the connection part 33 to the interior of the container 31. A push rod 39 extends downwardly into the body to 36 to engage a valve 10 as discussed below.

To provide fluid under pressure to the container 31, a pressure source 40 is provided. The pressure source 40 comprises a pressure bottle 41 and a regulator 42 which includes a valve 10 as described above, the piston 12 having a seal 12*a* and being moveable in an end part 40*a* of the pressure source 40. In the regulator 42, a threaded screw 43 provides a connection to atmosphere for the volume below the piston 12. In this example, the threaded screw 43 also prevents movement of the piston 12 to the fourth position as a safety measure to prevent or hinder discharge of the pressure bottle 41 when it is not in use. When the pressure bottle 41 contains fluid under pressure and the pressure source 40 is not connected to the connection part 33, the valve 10 is in the third position as shown in FIG. 1*c*.

The pressure source 40 is introduced into the connection part 33 as shown in FIG. 4, by inserting the pressure source until it passes the seal 37. Pushing the pressure source in further brings the piston 12 into contact with the push rod 39. As described above, this urges the piston 12 away the third position and into the second position as shown in FIG. 5. Fluid under pressure is supplied from the valve 10 through vents 38 into the container 31. When the container 31 reaches a suitable pressure, as set by selecting the dimensions of the piston 12 and piston rod 17 as discussed above, the piston 12 will move to the first, equilibrium position as shown in FIG. 6.

Although the pressure source 40 and connection part 33 are shown located generally centrally of the container 31 and contained within the lower part of the container 31, a dispenser may be provided with the pressure source and container located and connected in any suitable manner.

It will be apparent that when the button 35 is pressed to dispense liquid from the container 31, the pressure within the container 31 will fall. Accordingly, the piston 12 will be forced upwards and fluid under pressure will be supplied into the container 31 until an equilibrium pressure is once again achieved.

When it is desired to refill the pressure bottle 41, the threaded screw 43 is removed or sufficiently withdrawn to permit movement of the piston 12 to the fourth position. The valve 10 can then be engaged with a suitable refilling nozzle 44 which urges the piston 12 to the fourth position as shown in FIG. 7. Pressure is supplied from a channel 45 of the nozzle 44 through bore 18 and outlet 19 into the pressure bottle 41. When it is desired to refill the container 31, the cap 32 or the connection part 33 can be removed to permit liquid to be introduced to the container 31, and then closed with a suitable liquid- and pressure-tight seal. Alternatively, if suitable the liquid to be dispensed may be introduced into the container 31 through vents 38 prior to inserting the pressure source 40.

It will be apparent that the dispenser is advantageous in that it allows an aerosol or dispenser to be provided which is capable of being refilled with both the liquid to be dispensed and propellant. Accordingly, this provides substantial advantages over known aerosols where the entire container must be thrown away, representing a substantial waste of resources, once the contents have been discharged.

The dispenser is also advantageous as the use of the valve 10 permits nitrogen or carbon dioxide to be reliably used. Nitrogen or carbon dioxide will not have the environmentally damaging effects of known propellants and are comparatively cheap to produce and distribute. Nitrogen and carbon dioxide are also inert, relatively inexpensive and will not have the risks associated with known flammable propellants. For example, to provide a pressure within the container of approximately 75-250 psi, the pressure source can contain liquid nitrogen at approximately 4000 psi. The areas of the piston and the rod would be selected so that the valve element moves to its first, equilibrium position when these pressures are applied to the outlet and inlet of the valve 10 respectively. 1 cc of liquid nitrogen would give 696.5 cc as a gas at 70 C. A pressure source with a volume of 12 cc could therefore provide propellant for approximately 10 discharges of the dispenser.

It will be apparent that the pressure source, comprising a pressure bottle and a valve 10, may be used separately, for any suitable function.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A valve comprising an inlet and an outlet, the valve having a valve element moveable between a first equilibrium position and a second open position, wherein when the valve element is in the first position, the inlet and the outlet are not in flow communication and when the valve element is in the second position the inlet and the outlet are in flow communication, and wherein the valve element is moveable reversibly from the first position to the second position by opposing fluid pressures at the inlet and the outlet, wherein the valve element is moveable to a third position in response to the opposing fluid pressures at the inlet and the outlet wherein the inlet and outlet are not in flow communication.

2. A valve according to claim 1 wherein the valve element comprises a piston having a first surface area responsive to fluid pressure at the outlet and a second smaller surface area responsive to the fluid pressure at the inlet, wherein the piston is moveable in response to the net force on the first and second surface areas.

3. A valve according to claim 2 wherein the piston is moveable in a first bore in flow communication with the outlet and the second surface area is provided on a rod attached to the piston and moveable in a second bore in flow communication with the inlet.

4. A valve according to claim 3 wherein a through-bore is provided in the rod, and an upper seal and a lower seal are provided to provide a sliding seal between the rod and the second bore.

5. A valve according to claim 4 wherein, in the second position, an end part of the rod is located between the upper seal and lower seal such that fluid is able to pass the lower seal, around the rod and enter the throughbore.

6. A valve according to claim 1 wherein the valve element is moveable to a fourth position to permit fluid flow from the outlet to the inlet.

7. A valve according to claim 1 wherein the valve element moves between the first position and the second position solely in response to the opposing fluid pressures at the inlet and outlet and no bias element or control element is present to move the valve element between the first and second positions.

8. A dispenser comprising a container and a nozzle to release liquid under pressure from the container, the dispenser further comprising a pressure source to supply fluid under pressure to the container, the pressure source and container being connected by a valve according to claim 1.

9. A dispenser according to claim 8 wherein the pressure source is releasably connectable to the container.

10. A dispenser according to claim 9 wherein the pressure source comprises the valve and a pressure bottle.

11. A dispenser comprising a container and a nozzle to release liquid under pressure from the container, the dispenser further comprising a pressure source to supply fluid under pressure to the container, the pressure source and container being connected by a valve according to claim 1, wherein the container has a connection part to engage the pressure source, the connection part having a push rod to urge the valve element from the third position to the second position when the pressure source is engaged with the container.

12. A dispenser according to claim 8 wherein the nozzle is connectable to a tube extending into the container, to permit liquid to be dispensed from the container.

13. A dispenser according to claim 8 wherein the liquid is dispensed as one of a spray, a jet or a foam.

14. A dispenser comprising a container and a nozzle to release liquid under pressure from the container, the dispenser further comprising a pressure source to supply fluid under pressure to the container, the pressure source and container being connected by a valve according to claim 5, wherein the valve element is moveable to the third position in response to the pressure at the inlet and outlet wherein the inlet and outlet are not in flow communication, and the container has a connection part to engage the pressure source, the connection part having a push rod to urge the valve element from the third position to the second position when the pressure source is engaged with the container.

15. A dispenser comprising a container and a nozzle to release liquid under pressure from the container, the dispenser further comprising a pressure source to supply fluid under pressure to the container, the pressure source and container being connected by a valve according to claim 5, wherein the valve element is moveable to the third position in response to the pressure at the inlet and outlet wherein the inlet and outlet are not in flow communication, and the valve element is moveable to a fourth position to permit fluid flow from the outlet to the inlet, and the container has a connection part to engage the pressure source, the connection part having a push rod to urge the valve element from the third position to the second position when the pressure source is engaged with the container.

16. A dispenser comprising a container and a nozzle to release liquid under pressure from the container, the dispenser further comprising a pressure source to supply fluid under pressure to the container, the pressure source and container being connected by a valve according to claim 5, wherein the valve element is moveable to the third position in response to the pressure at the inlet and outlet wherein the inlet and outlet are not in flow communication, and the valve element is moveable to a fourth position to permit fluid flow from the outlet to the inlet, wherein the valve element moves between the first position and the second position solely in response to the pressures at the inlet and outlet and no bias element or control element is present to move the valve element between the first and second positions, and the container has a connection part to engage the pressure source, the connection part having a push rod to urge the valve element from the third position to the second position when the pressure source is engaged with the container.

* * * * *